US010127848B2

(12) United States Patent
Kang

(10) Patent No.: US 10,127,848 B2
(45) Date of Patent: Nov. 13, 2018

(54) DISPLAY DEVICE

(71) Applicant: SAMSUNG DISPLAY CO., LTD., Yongin-si, Gyeonggi-do (KR)

(72) Inventor: Hyung Ryul Kang, Yongin-si (KR)

(73) Assignee: SAMSUNG DISPLAY CO., LTD., Yongin-si, Gyeonggi-do (KR)

( * ) Notice: Subject to any disclaimer, the term of this patent is extended or adjusted under 35 U.S.C. 154(b) by 0 days.

(21) Appl. No.: 15/163,711

(22) Filed: May 25, 2016

(65) Prior Publication Data

US 2017/0084226 A1 Mar. 23, 2017

(30) Foreign Application Priority Data

Sep. 18, 2015 (KR) ..... 10-2015-0132409

(51) Int. Cl.
*G09G 3/20* (2006.01)

(52) U.S. Cl.
CPC ..... *G09G 3/20* (2013.01); *G09G 2310/0221* (2013.01); *G09G 2310/0267* (2013.01); *G09G 2310/04* (2013.01)

(58) Field of Classification Search
CPC ..... G09G 2310/0221; G09G 3/20
USPC ..... 345/76–107
See application file for complete search history.

(56) References Cited

U.S. PATENT DOCUMENTS 7,057,586 B2 * 6/2006 Moon ..... G09G 3/22 345/213
2009/0284500 A1 * 11/2009 Yamashita ..... G09G 3/3666 345/204
2013/0033434 A1 * 2/2013 Richardson ..... G06F 3/0488 345/173
2015/0287365 A1 * 10/2015 Song ..... G09G 3/344 345/206

FOREIGN PATENT DOCUMENTS

KR 10-2015-0033903 A 4/2015

* cited by examiner

*Primary Examiner* — Michael Pervan
(74) *Attorney, Agent, or Firm* — Lee & Morse, P.C.

(57) ABSTRACT

A display device, including a display panel including a plurality of pixels coupled to scan lines and data lines, the display panel having a display area divided into a first display area at a first side thereof and a second display area at a second side opposite to the first side; a scan driver to supply a scan signal through the scan lines; and a data driver to supply a data signal through the data lines, the scan lines including first sub-scan lines corresponding to the first display area and second sub-scan lines corresponding to the second display area, and switching elements being coupled between the first sub-scan lines and the second sub-scan lines.

10 Claims, 3 Drawing Sheets

DISPLAY DEVICE

CROSS-REFERENCE TO RELATED APPLICATION

Korean Patent Application No. 10-2015-0132409, filed on Sep. 18, 2015, in the Korean Intellectual Property Office, and entitled: "Display Device," is incorporated by reference herein in its entirety.

BACKGROUND

1. Field

Embodiments relate to a display device.

2. Description of the Related Art

Various types of display devices may be capable of reducing the weight and volume of cathode ray tubes. Such display devices may include, for example, a liquid crystal display device, a field emission display device, a plasma display panel, and an organic light emitting display device.

SUMMARY

Embodiments may be realized by providing a display device, including a display panel including a plurality of pixels coupled to scan lines and data lines, the display panel having a display area divided into a first display area at a first side thereof and a second display area at a second side opposite to the first side; a scan driver to supply a scan signal through the scan lines; and a data driver to supply a data signal through the data lines, the scan lines including first sub-scan lines corresponding to the first display area and second sub-scan lines corresponding to the second display area, and switching elements being coupled between the first sub-scan lines and the second sub-scan lines.

The display device may further include a display area selector to generate a control signal to selectively turn on or turn off the switching elements.

The scan driver may include a first scan driver to supply the scan signal to the first sub-scan lines; and a second scan driver to supply the scan signal to the second sub-scan lines.

The switching elements may include first switching elements coupled to the first sub-scan lines; and second switching elements coupled to the second sub-scan lines.

The display area may include a third display area between the first display area and the second display area.

The scan lines may further include third sub-scan lines corresponding to a first portion of the third display area and fourth sub-scan lines corresponding to a second portion of the third display area, and the third sub-scan lines and the fourth sub-scan lines may be separated from each other.

The switching elements may include first switching elements coupled between the first sub-scan lines and the third sub-scan lines; and second switching elements coupled between the second sub-scan lines and the fourth sub-scan lines.

The first to fourth sub-scan lines may correspond one by one to each other.

The first display area and the second display area may each correspond to a curved area of the display area, and the third display area may correspond to a flat area of the display panel.

The first, second, and third display areas may be divided in a direction intersecting the scan lines.

The display device may further include a display area selector to generate a first control signal to turn on or turn off the first switching elements and a second control signal to turn on or turn off the second switching elements.

The display area selector may generate the first control signal and the second control signal according to a partial display mode input signal.

The display device may further include a timing controller to control the scan driver and the data driver.

BRIEF DESCRIPTION OF THE DRAWINGS

Features will become apparent to those of skill in the art by describing in detail exemplary embodiments with reference to the attached drawings in which.

DETAILED DESCRIPTION

Figure 1A:
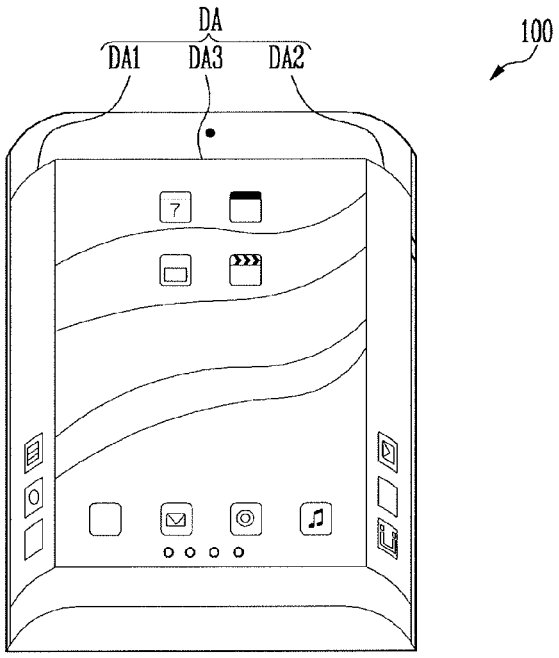
FIG. 1A illustrates an exemplary view of a display device applied to a portable terminal according to an embodiment.

Example embodiments will now be described more fully hereinafter with reference to the accompanying drawings; however, they may be embodied in different forms and should not be construed as limited to the embodiments set forth herein. Rather, these embodiments are provided so that this disclosure will be thorough and complete, and will fully convey exemplary implementations to those skilled in the art.

In the drawing figures, the dimensions of layers and regions may be exaggerated for clarity of illustration. Like reference numerals refer to like elements throughout.

Figure 1B:
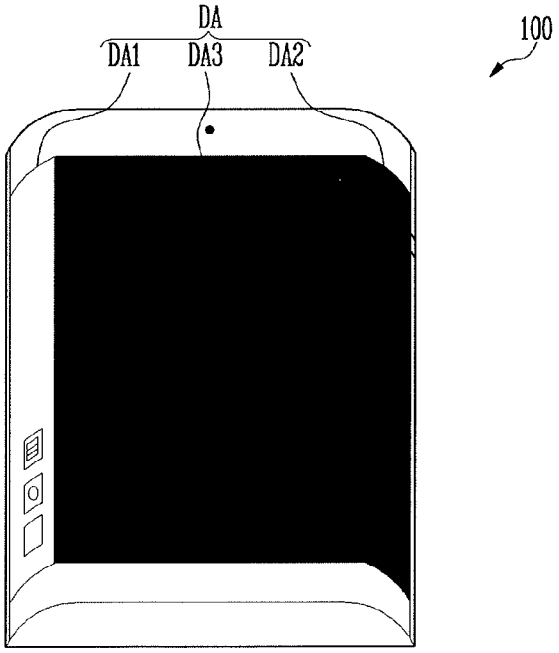
FIGS. 1B and 1C illustrate exemplary views of the display device in a partial display mode.
Figure 1C:
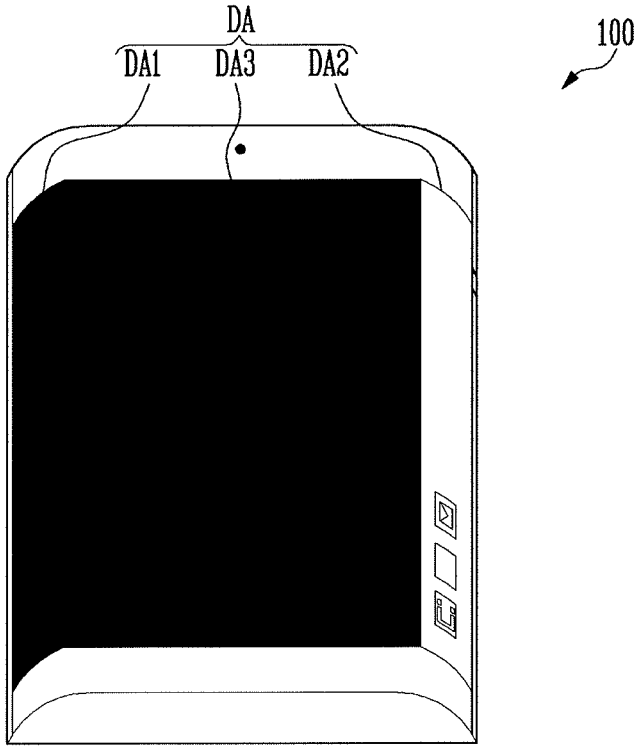

FIG. 1A illustrates an exemplary view of a display device applied to a portable terminal according to an embodiment, and FIGS. 1B and 1C illustrate exemplary views of the display device in a partial display mode.

Referring to FIGS. 1A, 1B, and 1C, the display device 100 according to an embodiment may be provided in a portable terminal such as a smart phone. The display device 100 may employ a curved display panel in which edge areas at both sides of the display panel are curved, and may be divided into a plurality of display areas DA. For example, the display areas DA may be defined as a first display area DA1 and a second display area DA2, corresponding to curved areas at both sides of the display panel, and a third display area DA3 corresponding to a flat area. The first display area DA1 and the second display area DA2 may have a smaller area than the third display area DA3. The first display area DA1 and the second display area DA2 may be sub-displays, and, for example, icons, a current time, or character messages, may be displayed in the first display area DA1 and the second display area DA2. The third display area DA3 may be a main display, and general images may be displayed in the third display area DA3. In an embodiment, the structure and shape of the display panel and the number of the divided display areas DA may be variously modified.

The display device 100 may implement a partial display mode so as to reduce power consumption. In a partial display mode, a portion of the divided display areas DA1, DA2, and DA3 may be selectively off. The off-display area means a display area in which light may not be emitted. For example, as shown in FIG. 1B, in a first partial display mode of the display device 100, only the first display area DA1 may be displayed, e.g., may display content, and the second display area DA2 and the third display area DA3 may be off. As shown in FIG. 1C, in a second partial display mode of the display device 100, only the second display area DA2 may be displayed, e.g., may display content, and the first display area DA1 and the third display area DA3 may be off. In an embodiment, the display device 100 may output black data for displaying black in an off-display area, and afterimages may be prevented.

Figure 2:
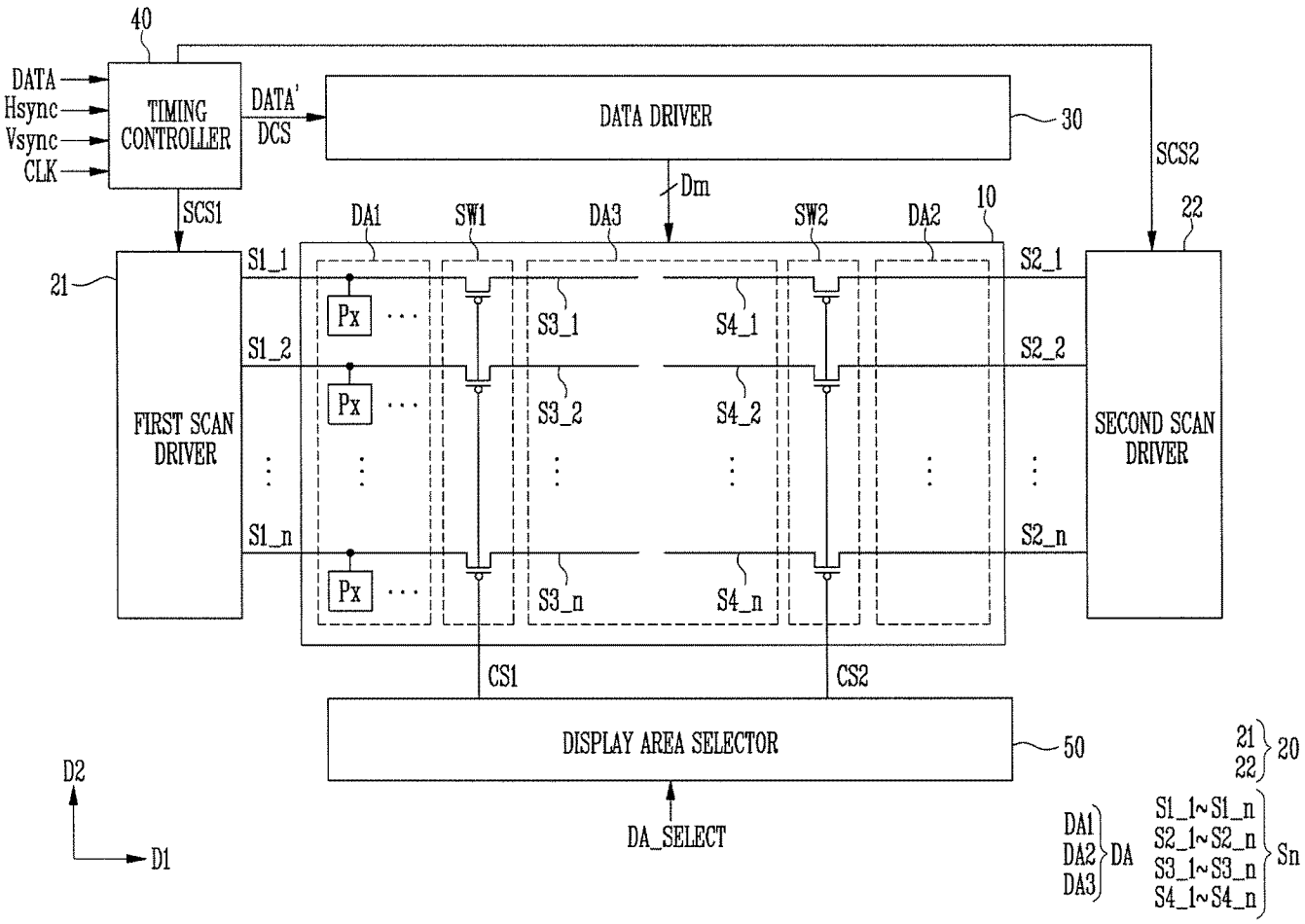
FIG. 2 illustrates a schematic configuration view of a display device according to an embodiment.

FIG. 2 illustrates a schematic configuration view of a display device according to an embodiment.

Referring to FIG. 2, the display device according to an embodiment may include a display panel 10, a scan driver 20, a data driver 30, a timing controller 40, and a display area selector 50.

The display panel 10 may include a plurality of pixels Px coupled to a plurality of scan lines Sn formed in a first direction D1 and a plurality of data lines Dm formed in a second direction D2 intersecting the first direction D1, the plurality of pixels Px being arranged in a matrix form. The pixel Px may receive a scan signal input through the scan lines Sn and may receive a data signal input through the data lines Dm. The pixels Px may emit light of a luminance corresponding to a data signal supplied from the data lines Dm when a scan signal is supplied from the scan lines Sn. In an embodiment, the display panel 10 may be an organic light emitting display panel. Various structures may be applied to a pixel circuit of each of the pixels Px, and detailed description of the pixel circuit will be omitted.

A display area DA in which an image is displayed by the pixels Px may be divided into a plurality of display areas. The display area DA may include a first display area DA1 located at one side thereof, a second display area DA2 located at the other side opposite to the one side, and a third display area DA3 located between the first display area DA1 and the second display area DA2. Referring to FIG. 1A described above, the first display area DA1 and the second display area DA2 may respectively correspond to curved areas at both sides of the display panel 10, and the third display area DA3 may correspond to a flat area at the center of the display panel 10. The first, second, and third display areas DA1, DA2, and DA3 may be divided in units parallel to the second direction D2. The display panel 10 may be divided, for example, into the first, second, and third areas DA1, DA2, and DA3, that may be obtained by vertically dividing the display area DA into three areas. In an embodiment, the shape, number, and size of the display areas may be variously modified.

The scan lines Sn arranged in the display area DA may be divided into a plurality of sub-scan lines corresponding to the display areas. The scan lines Sn may include first sub-scan lines S1_1 to S1_*n* corresponding to the first display area DA1 and second sub-scan lines S2_1 to S2_*n* corresponding to the second display area DA2. The scan lines Sn may include third sub-scan lines S3_1 to S3_*n* corresponding to a portion of the third display area DA3 and fourth sub-scan lines S4_1 to S4_*n* corresponding to another portion of the third display area DA3. The third sub-scan lines S3_1 to S3_*n* and the fourth sub-scan lines S4_1 to S4_*n* may not be coupled to each other, and may be separated from each other. The sub-scan lines may correspond one by one to each other along horizontal lines, and the numbers of the first to fourth sub-scan lines may be equal to each other. In an embodiment, the arrangement structure of the sub-scan lines may be variously modified. For example, the third display area DA3 may include only sub-scan lines corresponding to the whole of the third display area DA3, and the sub-scan lines may have a structure separated from the first sub-scan lines S1_1 to S1_*n* or the second sub-scan lines S2_1 to S2_2 adjacent thereto.

Switching elements coupled to sub-scan lines corresponding to display areas may be located between the display areas. First switching elements SW1 may be coupled between the first sub-scan lines S1_1 to S1_*n* and the third sub-scan lines S3_1 to S3_*n*, and second switching elements SW2 may be coupled between the second sub-scan lines S2_1 to S2_*n* and the fourth sub-scan lines S4_1 to S4_*n*. The first switching elements SW1 may be arranged along a boundary line between the first display area DA1 and the second display area DA2, and the second switching elements SW2 may be arranged along a boundary line between the second display area DA2 and the third display area DA3. Any switching elements may not be coupled between the third sub-scan lines S3_1 to S3_*n* and the fourth sub-scan lines S4_1 to S4_*n* in the third display area DA3. The switching elements may correspond one by one to sub-scan lines coupled thereto, and the number of the first switching elements SW1 or the number of the second switching elements SW2 may be equal to the number of each of the first to fourth sub-scan lines.

The scan driver 20 may be coupled to the scan lines Sn. The scan driver 20 may generate a scan signal in response to scan control signals SCS1 and SCS2 of the timing controller 40, and may output the generated scan signal to the scan lines Sn. In an embodiment, the scan driver 20 may be configured with a plurality of stage circuits, and sequentially supply a scan signal to the scan lines Sn. The scan signal may be sequentially supplied to the scan lines Sn, and the pixels Px may be selected in units of rows.

The scan driver 20 may include a first scan driver 21 for supplying a scan signal to the first sub-scan lines S_1 to S1_*n* and a second scan driver 22 for supplying a scan signal to the second sub-scan lines S2_1 to S2_*n*. The scan signal supplied from the first scan driver 21 and the scan signal supplied from the second scan driver 22 may be substantially identical to each other. The first scan driver 21 and the second scan driver 22 may output a scan signal to pixels in any one column at the same timing, e.g., at the same time. The pixels in the third display area DA3 may not be directly coupled to the first and second scan drivers 21 and 22, and a scan signal may be transmitted based on whether the first switching elements SW1 and the second switching elements SW2 are turned on.

The data driver 30 may be coupled to the data lines Dm. The data driver 30 may generate a data signal in response to a data control signal DCS, and may output the generated data signal to the data lines Dm. The data driver 30 may convert image data DATA' in a digital form, which may be provided from the timing controller 40, into a data signal in an analog form, and may output the converted data signal to the data lines Dm.

The timing controller 40 may receive, for example, image data DATA, synchronization signals Hsync and Vsync, and a clock signal CLK, for controlling display of the image data DATA. The timing controller 40 may generate corrected image data DATA' suitable for image display of the display panel 10 by image-processing the input data DATA, and may output the generated image data DATA' to the data driver 30. The timing controller 40 may generate driving control signals SCS1, SCS2, and DCS for controlling driving of the scan driver 20 and the data driver 30, based on the synchronization signals Hsync and Vsync and the clock signal CLK.

The display area selector 50 may generate a control signal for selectively turning on or turning off switching elements.

The display area selector 50 may generate a first control signal CS1 for turning on or turning off the first switching elements SW1 and a second control signal CS2 for turning on or turning off the second switching elements SW2. The first switching elements SW1 may be simultaneously turned on or turned off by the first control signal CS1, and the second switching elements SW2 may be simultaneously turned on or turned off by the second control signal CS2. The first switching elements SW1 and the second switching elements SW2 may be simultaneously turned on or turned off. The display area selector 50 may generate the first and second control signals CS1 and CS2 according to a partial display mode input signal DA_SELECT.

For example, in a normal display mode in which all the display areas DA1, DA2, and DA3 display images, the first switching elements SW1 and the second switching elements SW2 may maintain a turn-on state. When the first switching elements SW1 are in the turn-on state, the scan signal supplied from the first scan driver 21 may be transmitted to the third sub-scan lines S3_1 to S3_*n* via the first sub-scan lines S1_1 to S1_*n*. When the second switching elements SW2 are in the turn-on state, the scan signal supplied from the second scan driver 22 may be transmitted to the fourth sub-scan lines S4_1 to S4_*n* via the second sub-scan lines S2_1 to S2_*n*. The scan signal may be supplied to the all the sub-scan lines, and all the display areas DA1, DA2, and DA3 may be displayed, e.g., may display content.

In a partial display mode in which one of the first display area DA1 and the second display area DA2 is displayed, the display area selector 50 may generate and output the first and second control signals CS1 and CS2 for turning off the first switching elements SW1 and the second switching elements SW2. When the first switching elements SW1 are in a turn-off state, the scan signal supplied from the first scan driver 21 may be supplied to only the first sub-scan lines S1_1 to S1_*n*, and may not be transmitted to the third sub-scan lines S3_1 to S3_*n*. When the second switching elements SW2 are in the turn-off state, the scan signal supplied from the second scan driver 22 may be supplied to only the second sub-scan lines S2_1 to S2_*n*, and may not be transmitted to the fourth sub-scan lines S4_1 to S4_*n*.

As shown in FIG. 1B described above, in the first partial display mode in which only the first display area DA1 is displayed, only the first scan driver 21 may output a scan signal in the state in which the first switching elements SW1 and the second switching elements SW2 are turned off. The scan signal may be supplied to only the first sub-scan lines S1_1 to S1_*n*, only the first display area may be displayed, e.g., may display content, and the second and third display areas DA2 and DA3 may be off.

As shown in FIG. 1C described above, in the second partial display mode in which only the second display area DA2 is displayed, only the second scan driver 22 may output a scan signal in the state in which the first switching elements SW1 and the second switching elements SW2 are turned off. The scan signal may be supplied to only the second sub-scan lines S2_1 to S2_*n*, only the second display area DA2 may be displayed, e.g., may display content, and the first and third display areas DA1 and DA3 may be off.

In an embodiment, only one scan driver may be provided, and a display area may be divided into a first display area at one side thereof and a second display area at the other side thereof. Switching elements may be coupled between first sub-scan lines corresponding to the first display area and second sub-scan lines corresponding to the second display area. In a partial display mode, the switching elements may be turned off, and only one of the first and second display areas may be displayed, e.g., may display content. If the scan driver is coupled to the first sub-scan lines, when the switching elements are turned off, a scan signal may be supplied to only the first sub-scan lines, and may not be transmitted to the second sub-scan lines, and only the first display area may be displayed, e.g., may display content, and the second display area may be off.

As described above, according to embodiments, the switching elements may be coupled between the first sub-scan lines corresponding to the first display area and the second sub-scan lines corresponding to the second display area, and the coupling of sub-scan lines may be blocked by turning off switching elements in a partial display mode. Thus, the capacitance of the scan lines may be decreased, and power consumption may be reduced.

By way of summation and review, an organic light emitting display device may be implemented as not only a flat panel, but also a display panel having various characteristics, such as a flexible panel or a curved panel. A display panel employed in a mobile device may employ a partial display mode in which a display area divided into a plurality of areas may be selectively driven so as to reduce power consumption. In a comparative display device, although some display areas may be selectively driven in a partial display mode, unnecessary power consumption may occur to perform scan driving even on display areas which are turned off.

In an embodiment, a technique for minimizing power consumption in a partial display mode may be provided.

Example embodiments have been disclosed herein, and although specific terms are employed, they are used and are to be interpreted in a generic and descriptive sense only and not for purpose of limitation. In some instances, as would be apparent to one of skill in the art as of the filing of the present application, features, characteristics, and/or elements described in connection with a particular embodiment may be used singly or in combination with features, characteristics, and/or elements described in connection with other embodiments unless otherwise specifically indicated. Accordingly, it will be understood by those of skill in the art that various changes in form and details may be made without departing from the spirit and scope of the present invention as set forth in the following claims.

What is claimed is:

1. A display device, comprising:

a display panel including a plurality of pixels coupled to scan lines and data lines, the display panel having first switches and second switches, and a display area divided into a first display area at a first side thereof and a second display area at a second side opposite to the first side;

a scan driver to supply a scan signal through the scan lines;

a data driver to supply a data signal through the data lines; and a display area selector to generate a first control signal to turn on or turn off the first switches and a second control signal to turn on or turn off the second switches, the scan lines including first sub-scan lines corresponding to the first display area and second sub-scan lines corresponding to the second display area, the first switches and the second switches being coupled between the first sub-scan lines and the second sub-scan lines, the display area selector to generate the first control signal and the second control signal according to a partial display mode input signal.

2. The display device as claimed in claim 1, wherein the scan driver includes:

a first scan driver to supply the scan signal to the first sub-scan lines; and a second scan driver to supply the scan signal to the second sub-scan lines.

3. The display device as claimed in claim 1, wherein the:

first switches are coupled to the first sub-scan lines; and second switches are coupled to the second sub-scan lines.

4. The display device as claimed in claim 1, wherein the display area includes a third display area between the first display area and the second display area.

5. The display device as claimed in claim 4, wherein:

the scan lines further include third sub-scan lines corresponding to a first portion of the third display area and fourth sub-scan lines corresponding to a second portion of the third display area, and the third sub-scan lines and the fourth sub-scan lines are separated from each other.

6. The display device as claimed in claim 5, wherein the:

first switches are coupled between the first sub-scan lines and the third sub-scan lines; and second switches are coupled between the second sub-scan lines and the fourth sub-scan lines.

7. The display device as claimed in claim 6, wherein the first to fourth sub-scan lines correspond one by one to each other.

8. The display device as claimed in claim 4, wherein:

the first display area and the second display area each correspond to a curved area of the display area, and the third display area corresponds to a flat area of the display panel.

9. The display device as claimed in claim 4, wherein the first, second, and third display areas are divided in a direction intersecting the scan lines.

10. The display device as claimed in claim 1, further comprising a timing controller to control the scan driver and the data driver.

* * * * *